US010881157B1

(12) United States Patent
Anderson et al.

(10) Patent No.: US 10,881,157 B1
(45) Date of Patent: Jan. 5, 2021

(54) TEMPERATURE-READING FACE SHIELD

(71) Applicant: MAWCO Tech Inc., Houston, TX (US)

(72) Inventors: Alfred Lewis Anderson, Houston, TX (US); Winfred Fields, Sr., Richmond, TX (US); Manuel Fields, Cypress, TX (US); LaTonia Monique Fontenot, Magnolia, TX (US)

(73) Assignee: MAWCO TECH INC., Houston, TX (US)

( * ) Notice: Subject to any disclaimer, the term of this patent is extended or adjusted under 35 U.S.C. 154(b) by 0 days.

(21) Appl. No.: 16/924,065

(22) Filed: Jul. 8, 2020

(51) Int. Cl.
*A41D 13/11* (2006.01)

(52) U.S. Cl.
CPC ..... *A41D 13/1107* (2013.01)

(58) Field of Classification Search
CPC ... A41D 13/1107; A41D 13/1184; A61F 9/02; A61F 9/026; A61F 9/027; A61F 9/029; A63B 33/002; B63C 11/12; B63C 2011/121; B63C 2011/123; B63C 2011/125; B63C 2011/126; B63C 2011/128
See application file for complete search history.

(56) References Cited

U.S. PATENT DOCUMENTS 5,664,578 A * 9/1997 Boczan ..... A61B 5/01 600/549
10,219,743 B2 3/2019 Larsen
2007/0199567 A1 8/2007 Kanzer
2014/0005497 A1 1/2014 Larsen
2015/0126872 A1* 5/2015 Dubielczyk ..... A61B 5/1127 600/473
2015/0332576 A1* 11/2015 Son ..... G02C 11/10 340/686.6
2016/0081622 A1* 3/2016 Abreu ..... A61B 5/0008 600/549
2016/0199967 A1 7/2016 Johnson
(Continued)

FOREIGN PATENT DOCUMENTS

CN 203219954 10/2013
KR 20150017827 2/2015

OTHER PUBLICATIONS

LCRHallcrest, Feverscan(R) Forehead Temperature Indicators Brochure, downloaded from [[https://www.]]hallcrest.com/DesktopModules/Bring2mind/DMX/Download.aspx?Command=Core_Download&EntryId=105&language=en-US&PortalId=0&TabId=163 (2016).

*Primary Examiner* — Rachael E Bredefeld
*Assistant Examiner* — Camtu T Nguyen
(74) *Attorney, Agent, or Firm* — Daniel N. Lundeen; Lundeen & Lundeen PLLC

(57) ABSTRACT

Personal protective equipment (PPE) and a method of wearing the PPE integrating a temperature reader biasing the temperature reader into direct thermal contact with the forehead without projecting elements and without the use of tight straps, thereby improving the comfort of the wearer while still providing face shielding functionality and accurate temperature reading. The frame has a concave curvature opposite the forehead of the wearer and the thermochromic strip is disposed as a chord across the concavity to bias the thermochromic strip against the forehead, thus reliving some of the pressure from the nosepiece to the thermochromic strip.

21 Claims, 3 Drawing Sheets

(56) References Cited

U.S. PATENT DOCUMENTS

| | | | | |
|---|---|---|---|---|
| 2017/0119479 | A1* | 5/2017 | Saito | G02C 7/12 |
| 2018/0103913 | A1* | 4/2018 | Tzvieli | G06K 9/4628 |
| 2019/0125011 | A1 | 5/2019 | Eisenbrey et al. | |

* cited by examiner

TEMPERATURE-READING FACE SHIELD

FIELD OF THE INVENTION

This invention relates to personal protective equipment with an integral temperature reader.

BACKGROUND

In times of a pandemic, it is necessary for the general public, medical personnel, and/or other essential workers to wear personal protective equipment (PPE) such as a face shield or mask. It is also desired to monitor the body temperature of such personnel for fever as a biomarker of the onset of infection.

U.S. Pat. No. 10,219,743 B2 discloses a face mask such as an SCBA or respirator mask for a first responder, soldier, or other workers in stressful conditions and hot environments, having an integrated temperature sensor for the detection of heat related illnesses, such as heat exhaustion and heat stroke. The mask is provided with straps that wrap around the head of the wearer to hold the mask in place. The straps are tight to bias a sensor projecting from a pliable skirt into direct contact with the forehead of the human wearer and can thus be uncomfortable to wear.

What is needed is a PPE integrated with a temperature reader that can bias the temperature sensor into direct contact with the forehead without projecting elements and without the use of tight straps, thereby improving the comfort of the wearer while still providing accurate temperature readings.

Other references of interest include patent publications US 20190125011A1; CN 203219954U; US 20070199567A1; US 20160199674A1; KR 20150017827A1; and FEVERSCAN™ forehead thermometer literature.

SUMMARY

The present invention addresses the need in the art for personal protective equipment (PPE) that can bias a temperature sensor into direct contact with the forehead without projecting elements and without the use of tight straps, thereby improving the comfort of the wearer while still providing accurate temperature readings. Moreover, the present invention improves the comfort of fame-mounted PPE such as a face shield by distributing some of the biasing force from a nosepiece onto the temperature reader.

Embodiments of the present invention in one aspect provide a temperature-reading face shield, comprising: a frame comprising a nosepiece adapted to engage a nose of a human wearer; a pair of bows extending from opposite ends of the frame adapted to engage a surface of a head of the wearer above ears; a transparent sheet secured at opposite sides thereof to the respective bows to form a shield disposed outside the frame and adapted to be spaced in front of a face of the wearer; a temperature reader mounted at opposite ends at an inside surface the frame, the temperature reader presenting a smooth surface adapted to thermally engage a portion of a forehead of the wearer and comprising a temperature indicator visible through the shield; and wherein the frame has a concave curvature opposite the forehead of the wearer and the temperature reader is disposed as a chord across the concavity adapted to bias the smooth surface against a portion of the forehead.

Embodiments of the present invention in another aspect provide a method of integrating temperature reading into the wearing of PPE, comprising: engaging a nosepiece of a frame to a nose of a human wearer; engaging surface of a head of the wearer above ears with a pair of bows extending from opposite ends of the frame; securing a transparent sheet at opposite sides thereof to the bows to form a shield disposed outside the frame spaced in front of a face of the wearer; mounting a temperature reader at opposite ends at an inside surface to the frame, the temperature reader presenting a smooth surface to thermally engage a portion of a forehead of the wearer and comprising a temperature indicator visible through the shield; wherein the frame has a concave curvature opposite the forehead of the wearer and the temperature reader is disposed as a chord across the concavity to bias the smooth surface against a portion the forehead.

In another aspect, embodiments of the present invention provide temperature-reading safety glasses, comprising: a frame comprising a nosepiece adapted to engage a nose of a human wearer; a pair of bows extending from opposite ends of the frame adapted to engage a surface of a head of the wearer above ears; transparent safety lenses mounted in the frame; a temperature reader mounted at opposite ends at an inside surface the frame, the temperature reader presenting a smooth surface adapted to thermally engage a portion of a forehead of the wearer and comprising a temperature indicator visible around the frame; wherein the bows are concavely curved adjacent distal ends thereof so as to be capable of engaging a rounded portion of the head to bias the frame and the nosepiece against the nose; and wherein the frame has a concave curvature opposite the forehead of the wearer and the temperature reader is disposed as a chord across the concavity adapted to bias the smooth surface against a portion of the forehead.

In a further aspect, embodiments of the present invention provide a method of integrating temperature reading into the wearing of safety goggles, comprising: engaging a nosepiece of a frame to a nose of a human wearer, wherein transparent safety lenses are mounted in the frame; engaging surface of a head of the wearer above ears with a pair of bows extending from opposite ends of the frame; securing a transparent sheet at opposite sides thereof to the bows to form a shield disposed outside the frame spaced in front of a face of the wearer; mounting a temperature reader at opposite ends at an inside surface to the frame, the temperature reader presenting a smooth surface to thermally engage a portion of a forehead of the wearer and comprising a visible temperature indicator; wherein the frame has a concave curvature opposite the forehead of the wearer and the temperature reader is disposed as a chord across the concavity to bias the smooth surface against a portion the forehead.

DETAILED DESCRIPTION

Figure 1:
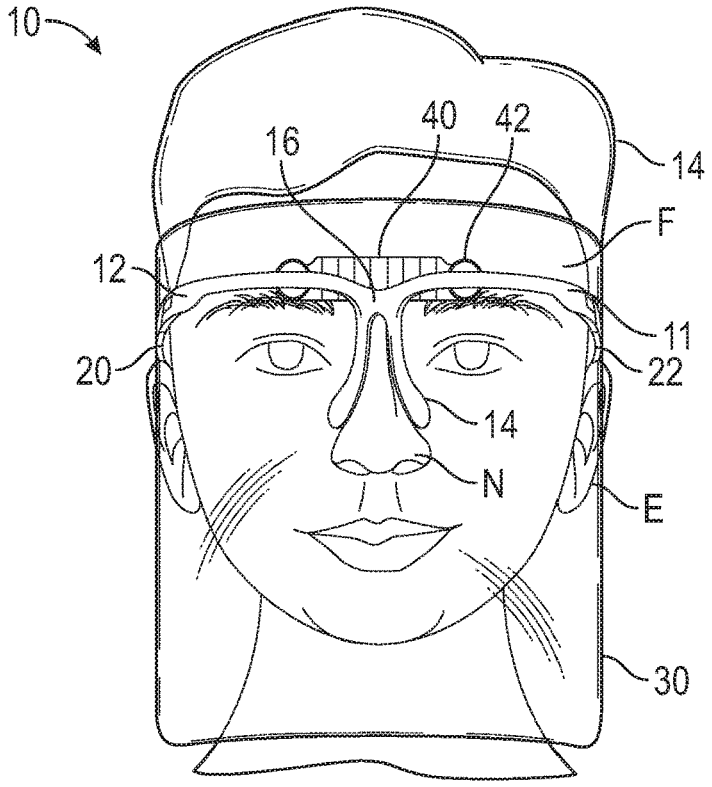
FIG. 1 shows a front perspective view of the face shield according to embodiments of the present invention.

Throughout the entire specification, including the claims, the following terms shall have the indicated meanings. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than the broadest meaning understood by skilled artisans, such a special or clarifying definition will be expressly set forth in the specification in a definitional manner that provides the special or clarifying definition for the term or phrase.

For example, the following discussion contains a non-exhaustive list of definitions of several specific terms used in this disclosure (other terms may be defined or clarified in a definitional manner elsewhere herein). These definitions are intended to clarify the meanings of the terms used herein. It is believed that the terms are used in a manner consistent with their ordinary meaning, but the definitions are nonetheless specified here for clarity.

A/an: The articles "a" and "an" as used herein mean one or more when applied to any feature in embodiments and implementations of the present invention described in the specification and claims. The use of "a" and "an" does not limit the meaning to a single feature unless such a limit is specifically stated. The term "a" or "an" entity refers to one or more of that entity. As such, the terms "a" (or "an"), "one or more" and "at least one" can be used interchangeably herein.

And/or: The term "and/or" placed between a first entity and a second entity means one of (1) the first entity, (2) the second entity, and (3) the first entity and the second entity. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements).

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of".

Bow: an elongated member connected, often hingedly, to the frame of eyeglasses and extending over the ear.

Comprising: In the claims, as well as in the specification, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03. Any device or method or system described herein can be comprised of, can consist of, or can consist essentially of any one or more of the described elements.

Frame: the front part of eyeglasses into which lenses or apertures are received.

Inside and outside: these terms refer to the perspective of the human wearer with respect to the frame, bows, nosepiece and so on, i.e., "inside" refers to the direction toward the wearer's head and "outside" refers to the direction away from the wearer's head.

In one aspect, embodiments of the present invention provide a temperature-reading face shield. The face shield comprises a frame comprising a nosepiece adapted to engage a nose of a human wearer. A pair of bows extend from opposite ends of the frame adapted to engage a surface of a head of the wearer above ears. A transparent sheet is secured at opposite sides thereof to the respective bows to form a shield disposed outside the frame and adapted to be spaced in front of a face of the wearer. A temperature reader is mounted at opposite ends at an inside surface the frame. The temperature reader presents a smooth surface adapted to thermally engage a portion of a forehead of the wearer and comprises a temperature indicator visible through the shield. The frame has a concave curvature opposite the forehead of the wearer and the temperature reader is disposed as a chord across the concavity adapted to bias the smooth surface against a portion of the forehead.

In any embodiment, the temperature reader preferably comprises a thermochromic strip, although any device which senses and displays an indication of temperature is broadly contemplated. The temperature reader is preferably secured to the frame by adhesive pads. The temperature reader is preferably replaceable via the pads, i.e., by delaminating the reader from the adhesive pads and/or the adhesive pads from the frame and re-adhering the replacement reader and/or adhesive pads.

In any embodiment, the frame preferably flexes adjacent the nosepiece when the pair of bows are biased outwardly. The pair of bows are preferably concavely curved adjacent distal ends so as to engage a rounded portion of the head. Preferably, the pair of bows are biased outwardly by the head of the wearer, the frame flexes adjacent the nosepiece when the pair of bows are biased outwardly, and the flexing of the frame is adapted to bias the temperature reader against the forehead.

In any embodiment, the shield is preferably secured to the pair of bows to outwardly bias the pair of bows. The shield is preferably secured to the pair of bows with a resilient barbed pin passing through respective holes in the shield and the pair of bows. The resilient barbed pins are preferably secured to the pair of bows with respective tethers and the tethers pass through a slot formed in edges of the shield and spaced from the holes in the shield.

In another aspect, embodiments of the present invention provide a method of integrating temperature reading into the wearing of personal protective equipment. The method can comprise (a) engaging a nosepiece of a frame to a nose of a human wearer; (b) engaging surface of a head of the wearer above ears with a pair of bows extending from opposite ends of the frame; (c) securing a transparent sheet at opposite sides thereof to the pair of bows to form a shield disposed outside the frame spaced in front of a face of the wearer; (d) mounting a temperature reader at opposite ends at an inside surface to the frame, the temperature reader presenting a smooth surface to thermally engage a portion of a forehead of the wearer and comprising a temperature indicator visible through the shield; and (e) wherein the frame has a concave curvature opposite the forehead of the wearer and the temperature reader is disposed as a chord across the concavity to bias the smooth surface against a portion the forehead.

In any embodiment of the method, the temperature reader preferably comprises a thermochromic strip, although any suitable temperature reader providing a visual display could be used. The method preferably further comprises securing the temperature reader to the frame by adhesive pads. Optionally, the method may further comprise replacing the temperature reader via the adhesive pads, i.e., by delaminating the reader from the adhesive pads and/or the adhesive pads from the frame and re-adhering the replacement reader and/or adhesive pads.

In any embodiment, the method may further comprise biasing the pair of bows outwardly to flex the frame adjacent the nosepiece. The pair of bows are preferably concavely curved adjacent distal ends to engage a rounded portion of the head. The pair of bows are preferably biased outwardly by the head of the wearer, wherein the frame flexes adjacent the nosepiece when the pair of bows are biased outwardly, and wherein the flexing of the frame biases the temperature reader against the forehead.

In any embodiment of the method, the shield is preferably secured to the pair of bows to outwardly bias the pair of bows. The method preferably further comprises securing the shield to the bows with a resilient barbed pin passing through respective holes in the shield and the pair of bows and/or securing the resilient barbed pins to the pair of bows with respective tethers and passing the tethers through a slot formed in edges of the shield and spaced from the holes in the shield.

Figure 2:
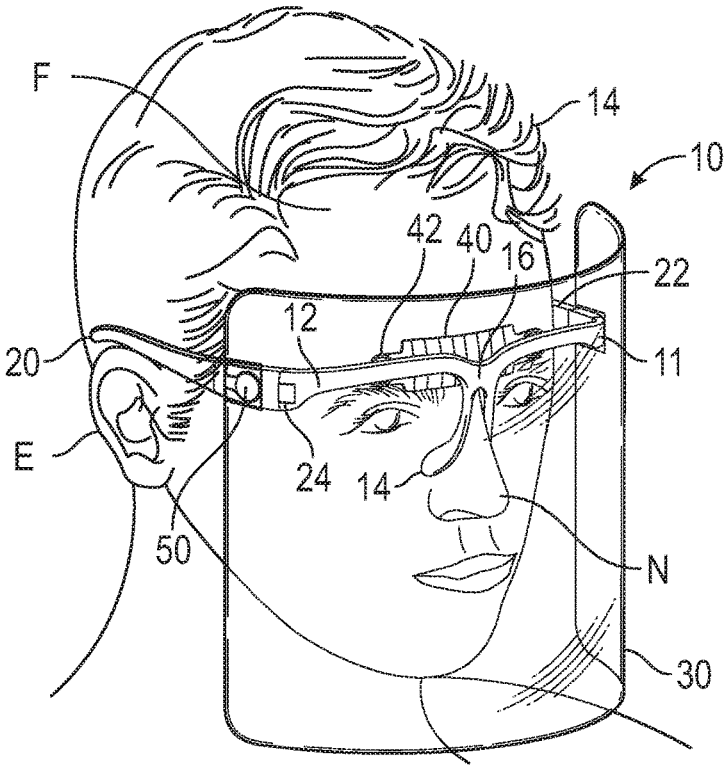
FIG. 2 shows a side sectional view of the face shield of FIG. 1 being worn by a user as seen along the view lines 2-2.

With reference to the drawings in which like parts are referenced by like numerals, a face shield 10 according to one embodiment of the present invention is shown in FIGS. 1-2.

Figure 3:
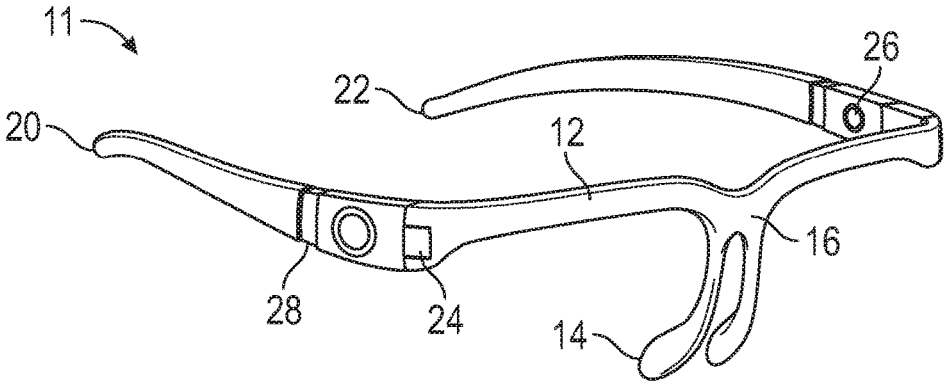
FIG. 3 shows an eyeglass assembly of the face shield of FIGS. 1-2.

The face shield 10 comprises an eyeglass assembly 11 best seen in FIG. 3, comprised of a frame 12, nosepiece 14, and bows 20, 22 hinged to the frame 11 at 24.

Figure 4:
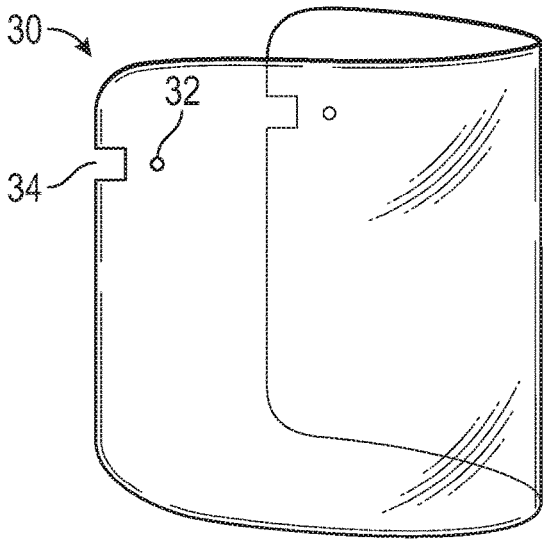
FIG. 4 shows a shield of the face shield of FIGS. 1-2.

As best seen in FIG. 4, transparent sheet 30 forming a shield is provided with holes 32 and slots 34 near opposite edges to facilitate attachment to the eyeglass assembly.

Figure 5:
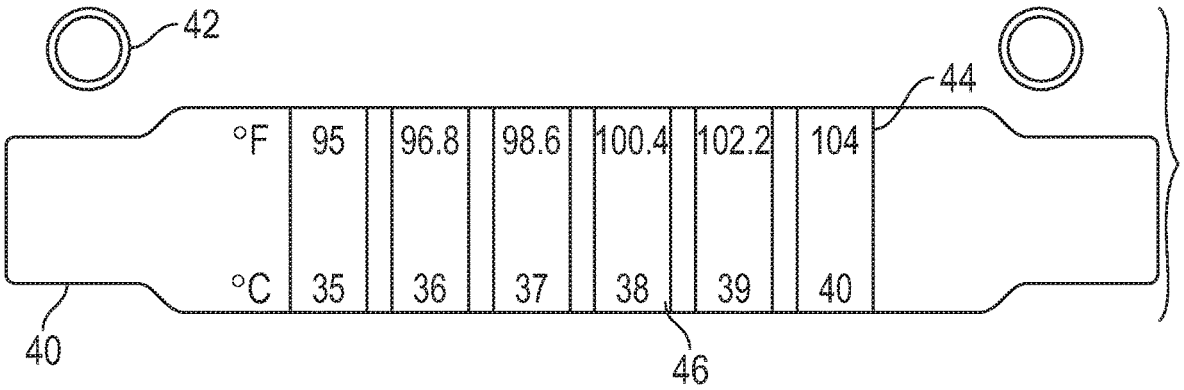
FIG. 5 shows an exploded view of thermometer and mounting pads of the face shield of FIGS. 1-2.

The temperature reader 40 is attached to an inside surface of the frame 12 using adhesive mounting pads 42, as best seen in FIG. 5.

Figure 6:
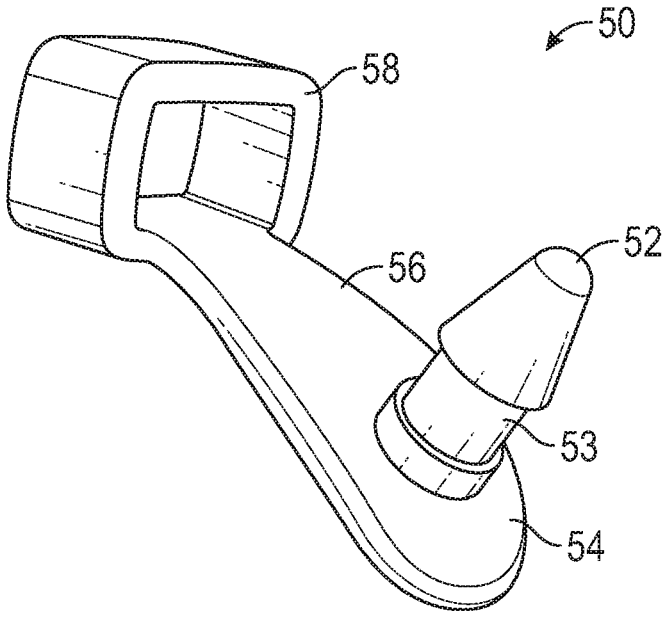
FIG. 6 shows a detailed view of the tethered pin for securing the shield to the bows of the face shield of FIGS. 1-2.
Figure 7:
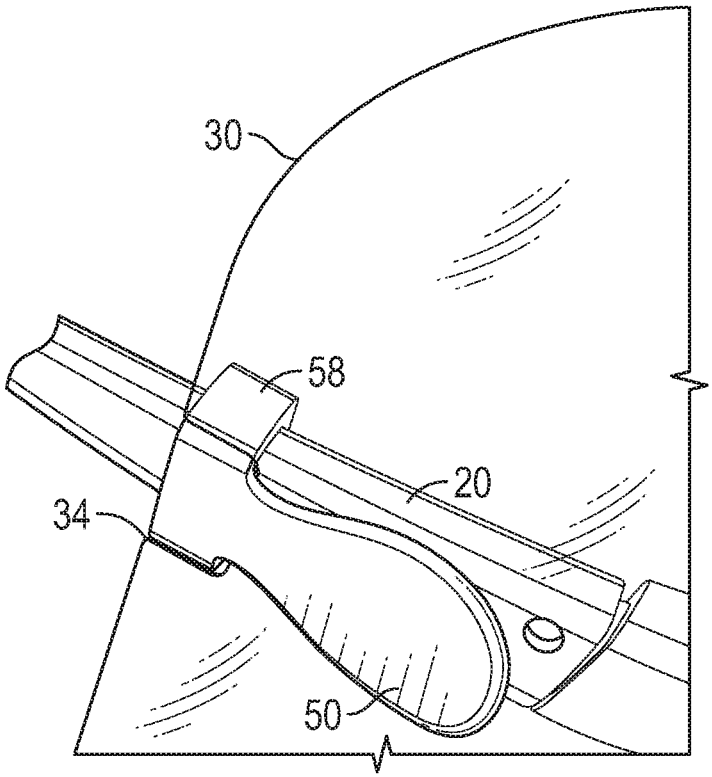
FIG. 7 shows a detailed view of the assembly of the shield of FIG. 4 to one of the bows of the eyeglass assembly of FIG. 3 using the tethered pin of FIG. 6.

FIG. 6 shows a tethered pin 50 used to assemble the shield 30 to the bows 20, 22 of the eyeglass assembly 11, which assembly is best seen in FIG. 7.

The frame 12 and nosepiece 14 are generally of unitary construction joined at the bridge 16. The bridge 16 is generally the same thickness as the main sections of the frame 14. Lenses (not shown) may optionally be secured to the frame 12 and/or nosepiece 14 according to the vision prescription of the wearer, or to provide magnification of the viewing field. Alternatively, the wearer may also use their own prescription glasses, positioning the nosepiece 14 behind the prescription glasses. The bows 20, 22 may be but are not necessarily hinged at 24 (see FIG. 3) to the frame 14 as is conventional in eyeglass construction.

The bows 20, 22 are generally curved inwardly to match a curvature of the skull H adjacent the ear E and generally extend behind the ear. In a relaxed condition, the distance between the bows 20, 22 is generally less than the corresponding distance across the skull H such that, in use, the bows 20,22 are biased outwardly. When the bows 20, 22 are biased outwardly, the curvature of the head H biases the frame 12 rearwardly such that the nosepiece 14 is biased against the nose N. Additionally, biasing the bows 20, 22 also flexes the frame 12 and tensions the temperature reader 40 via the pads 42, which are in a fixed location. This in turn biases the temperature reader 40 against the forehead F, relieving some of the biasing of the nosepiece 14 against the nose N, aiding in the comfort of wearing the device 10.

The temperature reader 40 is thus biased against the forehead F. Where the temperature reader 40 is a thermochromic strip, for example, it can be provided with a plurality of fields 44 that change color when exposed to a predetermined temperature, e.g., one at 98.6° F. (37° C.), another at 100.4° F. (38° C.), 102.2° F. (39° C.), and so on. The numerical temperatures 46 can be displayed in or adjacent to the corresponding fields 44. In this manner, as long as the person is wearing the shield, the wearer's temperature can be readily ascertained.

If desired, the temperature reader 40 can be secured to the frame 12 by means of adhesive mounting pads 42. The reader 40 can be replaced with a new one as needed by removing it and/or the pads 42 by delaminating the adhesive and securing the new ones as needed.

The shield 30 is transparent plastic and may be shipped or stored flat until assembly. The shield 30 may be stored or shipped with a protective plastic sheet (not shown) removably laminated to either side.

The shield 30 may be provided with a hole 32 and slot 34 formed on either edge thereof to facilitate attachment to the bows 20, 22. In attaching the shield 30 to the bows 20, 22, the hole 32 is positioned to coincide with one of holes 26 formed in the bows and pin 50 is inserted therein. The pin 50 can be provided with a barbed end 52 and be made of a resilient material to facilitate insertion. Once inserted, the pin 50 is retained by means of the barbed end 52, shank 53, and head 54 at an opposite end.

If desired, the pin 50 can be tethered to the respective bow 20, 22 by means of tether 56 which has a loop 58 formed in its opposite end. The loop 58 can be received in a matching groove 28 formed around the bows 20, 22. The tether 56 passes through the slot 34, which inhibits rotation of the shield 30, fixing it in relative position with respect to the bows 20,22.

Although only a few example embodiments have been described in detail above, those skilled in the art will readily appreciate that many modifications are possible in the example embodiments without materially departing from this invention. Accordingly, all such modifications are intended to be included within the scope of this invention as defined in the following claims. It is the express intention of the applicant not to invoke 35 U.S.C. § 112(f) for any limitations of any of the claims herein, except for those in which the claim expressly uses the words 'means for' together with an associated function and without any recitation of structure. The priority document is incorporated herein by reference.

What is claimed is:

1. A temperature-reading face shield, comprising:

a frame comprising a nosepiece adapted to engage a nose of a human wearer;

a pair of bows extending from opposite ends of the frame adapted to engage a surface of a head of the wearer above ears;

a transparent sheet secured at opposite sides thereof to the respective bows to form a shield disposed outside the frame and adapted to be spaced in front of a face of the wearer;

a temperature reader mounted at opposite ends at an inside surface to the frame, the temperature reader presenting a smooth surface adapted to engage a portion of a forehead of the wearer and sense a temperature thereof, and comprising a temperature indicator visible through the shield; and wherein the frame has a concave curvature opposite the forehead of the wearer and the temperature reader is disposed as a chord across the concavity adapted to bias the smooth surface against a portion of the forehead.

2. The temperature-reading face shield of claim 1 wherein the temperature reader comprises a thermochromic strip.

3. The temperature-reading face shield of claim 1 wherein the temperature reader is secured to the frame by adhesive pads.

4. The temperature-reading face shield of claim 3 wherein the temperature reader is replaceable via the adhesive pads.

5. The temperature-reading face shield of claim 1 wherein the frame flexes adjacent the nosepiece when the pair of bows are biased outwardly.

6. The temperature-reading face shield of claim 1 wherein the pair of bows are concavely curved adjacent distal ends thereof so as to be capable of engaging a rounded portion of the head to bias the frame and the nosepiece against a bridge of the nose.

7. The temperature-reading face shield of claim 6 wherein the pair of bows are adapted to be biased outwardly by the head of the wearer, wherein the frame flexes adjacent the nosepiece when the bows are biased outwardly, and wherein the flexing of the frame is capable of biasing the temperature reader against the forehead.

8. The temperature-reading face shield of claim 1 wherein the shield is secured to the bows to outwardly bias the pair of bows.

9. The temperature-reading face shield of claim 8 wherein the shield is secured to the pair of bows with a resilient barbed pin passing through respective holes in the shield and the bows.

10. The temperature-reading face shield of claim 9 wherein the resilient barbed pins are secured to the pair of bows with respective tethers and wherein the tethers pass through a slot formed in edges of the shield and spaced from the holes in the shield.

11. A method of integrating temperature reading into the wearing of personal protective equipment, comprising:

engaging a nosepiece of a frame to a nose of a human wearer;

engaging surface of a head of the wearer above ears with a pair of bows extending from opposite ends of the frame;

securing a transparent sheet at opposite sides thereof to the pair of bows to form a shield disposed outside the frame spaced in front of a face of the wearer;

mounting a temperature reader at opposite ends at an inside surface to the frame, the temperature reader presenting a smooth surface to engage a portion of a forehead of the wearer and sense a temperature thereof, and comprising a temperature indicator visible through the shield;

wherein the frame has a concave curvature opposite the forehead of the wearer and the temperature reader is disposed as a chord across the concavity to bias the smooth surface against a portion of the forehead.

12. The method of claim 11 wherein the temperature reader comprises a thermochromic strip.

13. The method of claim 11 further comprising securing the temperature reader to the frame by adhesive pads.

14. The method of claim 13 further comprising replacing the temperature reader via the adhesive pads.

15. The method of claim 11 further comprising biasing the pair of bows outwardly to flex the frame adjacent the nosepiece.

16. The method of claim 11 wherein the pair of bows are concavely curved adjacent distal ends so as to engage a rounded portion of the head.

17. The method of claim 16 wherein the pair of bows are biased outwardly by the head of the wearer, wherein the frame flexes adjacent the nosepiece when the bows are biased outwardly, and wherein the flexing of the frame biases the temperature reader against the forehead.

18. The method of claim 11 wherein the shield is secured to the pair of bows to outwardly bias the bows.

19. The method of claim 18 further comprising securing the shield to the pair of bows with a resilient barbed pin passing through respective holes in the shield and the bows.

20. The method of claim 19 further comprising securing the resilient barbed pins to the pair of bows with respective tethers and passing the tethers through a slot formed in edges of the shield and spaced from the holes in the shield.

21. A temperature-reading safety glasses, comprising:

a frame comprising a nosepiece adapted to engage a nose of a human wearer;

a pair of bows extending from opposite ends of the frame adapted to engage a surface of a head of the wearer above ears;

transparent safety lenses mounted in the frame;

a temperature reader mounted at opposite ends at an inside surface to the frame, the temperature reader presenting a smooth surface adapted to engage a portion of a forehead of the wearer and sense a temperature thereof, and comprising a temperature indicator visible around the frame;

wherein the bows are concavely curved adjacent distal ends thereof so as to be capable of engaging a rounded portion of the head to bias the frame and the nosepiece against the nose; and wherein the frame has a concave curvature opposite the forehead of the wearer and the temperature reader is disposed as a chord across the concavity adapted to bias the smooth surface against a portion of the forehead.

* * * * *